US007568372B1

(12) United States Patent
Patton et al.

(10) Patent No.: US 7,568,372 B1
(45) Date of Patent: Aug. 4, 2009

(54) HYDRAULIC RESCUE TOOL

(75) Inventors: Tommy L. Patton, 1495 W. 9th St., Ste. 101, Upland, CA (US) 91786; Edward H. Hagbloom, Rialto, CA (US)

(73) Assignee: Tommy L. Patton, Upland, CA (US)

( * ) Notice: Subject to any disclaimer, the term of this patent is extended or adjusted under 35 U.S.C. 154(b) by 0 days.

(21) Appl. No.: 12/152,004

(22) Filed: May 13, 2008

(51) Int. Cl.
*B21C 3/02* (2006.01)
*B21C 3/06* (2006.01)
*B21J 9/18* (2006.01)

(52) U.S. Cl. ..... 72/464; 72/705; 72/453.15

(58) Field of Classification Search ..... 72/705, 72/464, 477, 482.92, 453.15, 453.16, 392; 92/172, 255; 254/93 R, 93 H
See application file for complete search history.

(56) References Cited

U.S. PATENT DOCUMENTS

| | | | | |
|---|---|---|---|---|
| 2,447,401 | A | | 8/1948 | Ferguson et al. |
| 3,570,835 | A | | 3/1971 | McPherson |
| 3,819,153 | A | | 6/1974 | Hurst et al. |
| 4,333,330 | A | | 6/1982 | Porter |
| 4,392,263 | A | | 7/1983 | Amoroso |
| 4,506,445 | A | * | 3/1985 | Esten ..... 30/228 |
| 4,734,983 | A | | 4/1988 | Brick |
| 4,886,635 | A | | 12/1989 | Forster et al. |
| 5,301,533 | A | | 4/1994 | Jackson |
| 5,425,260 | A | | 6/1995 | Gehron |
| 5,544,862 | A | | 8/1996 | Hickerson |
| 5,622,353 | A | | 4/1997 | Painter et al. |
| 5,956,992 | A | | 9/1999 | Patton |
| 6,244,568 | B1 | | 6/2001 | Patton |
| 7,107,812 | B1 | | 9/2006 | Patton |

* cited by examiner

*Primary Examiner*—Dana Ross
*Assistant Examiner*—Teresa Bonk
(74) *Attorney, Agent, or Firm*—Albert O. Cota

(57) ABSTRACT

A hydraulic rescue tool (10) is comprised of a hydraulic thrust apparatus (20) consisting of a hydraulic cylinder body (24) having slots (28) within a hollow end and interlocking ears (36) protruding from the slots. A gland (38) is interfaced between the ears, with the gland and ears connected to the cylinder hollow end with threaded fasteners (98). A connecting link (50) is attached to each interlocking ear and a quick disconnect implement unit (22) is attached to each link and to a piston rod (30) within the cylinder body (24). Six dissimilar embodiments of implement units, each having quick disconnect capabilities and different vehicle structure separating utility are attached to the hydraulic thrust apparatus (20).

46 Claims, 14 Drawing Sheets

HYDRAULIC RESCUE TOOL

TECHNICAL FIELD

The invention generally pertains to rescue tools for emergency operations, and more specifically to a hydraulic tool that is designed to sever material, pry apart structural elements and crush material to rescue a person that is trapped in a damaged vehicle.

BACKGROUND ART

Previously, many types of rescue tools have been used to provide an effective means to pry or cut open damaged vehicles at the scene of an accident. Further, other machine tools have been developed with similar operational characteristics.

A search of the prior art did not disclose any patents or industry literature that read directly on the claims of the instant invention. However, the following U.S. patents are considered related:

| U.S. Pat. No. | Inventor | Issue Date |
|---|---|---|
| 3,819,153 | Hurst et al. | Jun. 25, 1974 |
| 4,333,330 | Porter | Jun. 8, 1982 |
| 4,392,263 | Amoroso | Jul. 12, 1983 |
| 4,734,983 | Brick | Apr. 5, 1988 |
| 5,301,533 | Jackson | Apr. 12, 1994 |
| 5,544,862 | Hickerson | Aug. 13, 1996 |
| 5,622,353 | Painter et al. | Apr. 22, 1997 |
| 5,956,992 | Patton | Sep. 28, 1999 |
| 6,244,568 | Patton | Jun. 12, 2001 |
| 7,107,812 | Patton | Sep. 19, 2006 |

Hurst in U.S. Pat. No. 3,819,153 teaches a portable rescue tool using fluid actuated force that is movable along the longitudinal axis of the base for positioning the arms to move the outer ends toward and way from each other to close and open.

U.S. Pat. No. 4,333,330 issued to Porter is for a spreader tool that has opposed force arms which are separated and pivoted while mounted on a base member. When separated and pivoted, the arms achieve annular movement in an opposite direction in response to axial movement of a driven piston of an associated jack. The inner edges of the arms rest upon rollers mounted on the forward end of the piston. A curve of the inner edge of the arms form an angle at which a constant axial force of the piston is applied to the arm by the roller such that the force is always constant.

Amoroso in U.S. Pat. No. 4,392,263 teaches a rescue tool including a body with a cylinder and an outward-extending piston. Jaw members are connected to the body with links and include outer prying portions, inner cutting portions and intermediate shearing portions. The tool may be powered by a bi-directional motor or directly from a wrecker motor vehicle system.

U.S. Pat. No. 4,734,983 issued to Brick teaches a cutting tool that is effective for cutting through sheet metal when extricating accident victims. The tool has one curved movable blade and one stationary blade. The stationary blade is formed on an anvil that is anchored within the frame of the tool and locked within the frame with a dowel.

U.S. Pat. No. 5,301,533 of Jackson discloses a machine tool that relates to manufacturing operations for gripping, clamping, piercing and hemming workpieces. Two pairs of arms are arranged in an opposed, inverted relationship with respect to each other and are pivotally connected at one end to the drive. Each arm has a cam formed therein. The cams in each of the pairs of arms are identically constructed in opposed inverted relationship. Cam followers, which are mounted on the linear drive member, engage the cams during movement to pivot the arms between the open and closed position. Each cam has an arcuate shape at an obtuse angle with respect to a pivot pin that connects each of the pairs of arms the drive.

U.S. Pat. No. 5,544,862 of Hickerson is for a spreading tool that is actuated by an electric motor. Torque at any position is achieved with selectable spreading or cutting motions using a rotary multiple stage speed-reducing gearbox, which is driven by a motor running on a 12 volt DC power supply.

Painter et al in U.S. Pat. No. 5,622,353 discloses a rescue tool having a pair of spreader arms with a pivot point therebetween. A pair of links attached to the arms are reciprocally moveable between retracted and extended positions along an axis of movement. A third pivotal coupling couples the spreader arm pivot point to the housing.

U.S. Pat. No. 5,956,992 issued to Patton, the instant inventor, is for a rescue tool consisting of a first arm that functions in combination with an interlocking second arm, which operates with a drive yoke. Another yoke includes a pair of cam pins that traverse a cam slot in each arm and a drive rod is connected to the drive yoke.

Patton's own U.S. Pat. No. 6,244,568 teaches a rescue spreading tool that provides a spreading, crushing or cutting motion. A stationary yoke is attached to a cylinder and a pair of spreader arms are attached to the cylinder and are free to rotate in opposed directions. A pusher cam yoke is formed integrally with the cylinder ram and engages the arms, thereby pushing them apart when the ram is extended. A pair of toggle links attached to the yoke continue to push the arms apart, thus creating a secondary thrust.

U.S. Pat. No. 7,107,812 also of Patton is for a hydraulic rescue tool utilizing a hydraulic cylinder with a yoke attached, with a handle for manipulating the tool. Rotation of the cylinder yoke prevents injury if the tool binds. Pivotal links connect the implement unit with quick release pins, thus making the implement unit easily removable. Two embodiments of the implement unit are taught, with a cutter unit for severing material and a spreader unit for prying apart structural elements when a vehicle is deformed to rescue a trapped victim.

For background purposes and as indicative of the art to which the invention is related, reference may be made to the remaining patents located in the patent search:

| U.S. Pat. No. | Inventor | Issue Date |
|---|---|---|
| 2,447,401 | Ferguson, et al. | Aug. 17, 1948 |
| 3,570,835 | McPherson | Mar. 16, 1971 |
| 4,886,635 | Forster, et al. | Dec. 12, 1998 |
| 5,425,260 | Gehron | Jun. 20, 1995 |

DISCLOSURE OF THE INVENTION

The problem with hydraulic rescue tools in the past has been insufficient power to accomplish the task at hand and excessive weight for emergency personnel to handle the tool efficiently. At the present time fuel economies and stricter government regulated impact safety standards have dramatically changed the design of motor vehicles. As an example, door hinges are now stamped of chromemoly steel, heat treated forgings and even Boron laminates. Windshield posts and roof lines, as well as side impact beams, now require high strength alloys. It is anticipated that by 2010 vehicles will utilize posts and roofing made of 0.120 inch (0.30 cm) thick Boron tubes that are heat treated to 55 Rockwell hardness and welded into the vehicle's roof structure.

As any tool that opens and closes, requires tremendous forces on a cylinder structure that is included on the tool. For example, typical production rescue tools today require from 100,000 pounds to 155,000 pounds of hydraulic force. It has been found that 200,000 pounds of force is now necessary to meet 5-star vehicle crash demands, thus necessitating a cylinder of equivalent strength. Further, mechanical structures of the tools now employed for this purpose are being flexed each time the tool is required to be fully loaded, thereby causing the cylinder to be oblonged at the front in time, which creates leaks or even catastrophic failures with continued use when the higher force loads are required.

The most serious problem is that many of the rescue tools in production today simply do not have the mechanical advantage and power required to handle the rescue tasks.

Therefore, the primary object of the invention is to provide a rescue tool that has sufficient power to sever or separate a vehicle structure that has been damaged and yet is light enough to be easily handled by emergency operation personnel. To overcome the pressure requirements and to be within the weight limitations the instant invention utilizes a hydraulic cylinder that has discrete ears made of a heat treated steel alloy. The ears penetrate an enlarged portion of the cylinder and are held in place between a removable gland with fasteners. This approach overcomes the weight of conventional aluminum ears that are integrally formed with the cylinder and the strength requirement of attachment yokes and brackets that have been positioned around the cylinder in the past. The use of a separate gland that is bolted in place permits higher pressures to be utilized as there are no threads, spiral locks, snap rings or welding requirements, as are required in the prior art rescue tools.

An important object of the invention is that one single thrust apparatus, consisting of the hydraulic cylinder with links attached to the encapsulated ears on each side, may be used in concert with multiple quick disconnect implement units that are easily detachable in the field. To detach the implement unit from the thrust apparatus only three pins must be removed, with each pin tethered to accommodate its quick release and ease of replacement.

Another object of the invention is that there are provisions for safety of the operator when pressure is forced to be increased the probability that a blade or arm may break off from the tool and become a missile has been a real fear for an operator. In the past safety cables have been used to overcome this problem, however it has been found that if breakage occurs the safety cable simply causes the blade or arm to return to its original location, thus creating a boomerang like which places the operator in an even greater jeopardy. The instant invention circumvents this problem by utilizing an energy absorbing member, which is constructed of flat malleable mild steel that is welded in place on an exposed underside surface of the blade or arm. If breakage occurs the energy absorbing member bends and stretches to keep the broken part from completely flying off.

Of less importance but potentially injurious is a pinch point located between the ears or pivot points and the links, which has been eliminated by encapsulating the joint with an integral barrier at the point of movement. Another possible concern is the pinching of the rear handle against a solid object since prior art handles are usually rigid. The rear handle of the instant invention is spring-loaded to yield, within limitations, thereby reducing, if not completely eliminating the pinching effect. The front handle has likewise been improved by using a bracket that is collapsible, which moves out of the way when engaging a solid structure and yet is positioned with a detent when used in an upright position.

Additionally, pressure relief valves are provided to limit the hydraulic pressure on either side of the piston rod for pushing and pulling actions, thereby preventing over pressurization.

Still another object of the invention is also related to the collapsible handle advantage as the handle may pivot down on an enlarged portion of the cylinder body when working in tight areas. The size of the thrust apparatus limits the ability to reach damaged areas in the vehicle structure.

Another advantage of the tool is the ability to fold down the front handle so that storage is easier, as storage areas in emergency vehicles are usually limited.

Yet another object of the invention is that the links have a hollowed out web in the sides and in the upper surface with finger grooves, thereby providing another gripping area to lift the tool during handling and operation. Another improvement is that force level markings are provided on the cutter and spreader arms, indicating to the operator the capabilities of the tool relative to the distance from the pivot point.

A further object of the invention is the ease of maintenance as the invention's sealing gland may be removed as a unit by detaching only two bolts and nuts protecting the seals on the piston or gland surface as there are no sharp threads or snap ring grooves that may be hit or scratch the lip of the seal. Further, the gland slides over the piston rod and since the sides are tapered, removal and replacement are easily accomplished.

A final object of the invention provides illumination of the three pins that allow removal and replacement of the quick disconnect implement unit. This convenient feature is accomplished by using a light emitting diode (LED) having an integral battery that is located within a knurled pin cap. Optionally, an additional LED can be added to the yoke which may become separated from the jaws, blades or arms of a structure separating apparatus during storage. Further, the pins utilized as link pins incorporate a retractable spring-loaded tether, which allows the link pin tether to be stored in tension in a hollow side of the link and when required is retracted under compression of the spring and returns to its at rest position when released permitting the link pin tether to be concealed within the linkage when not in use. The yoke pin is simply tethered to the yoke with a cable. All of the pins incorporate an adjustable spring-loaded detent which permits changing the amount of force required to remove the pin from the device.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
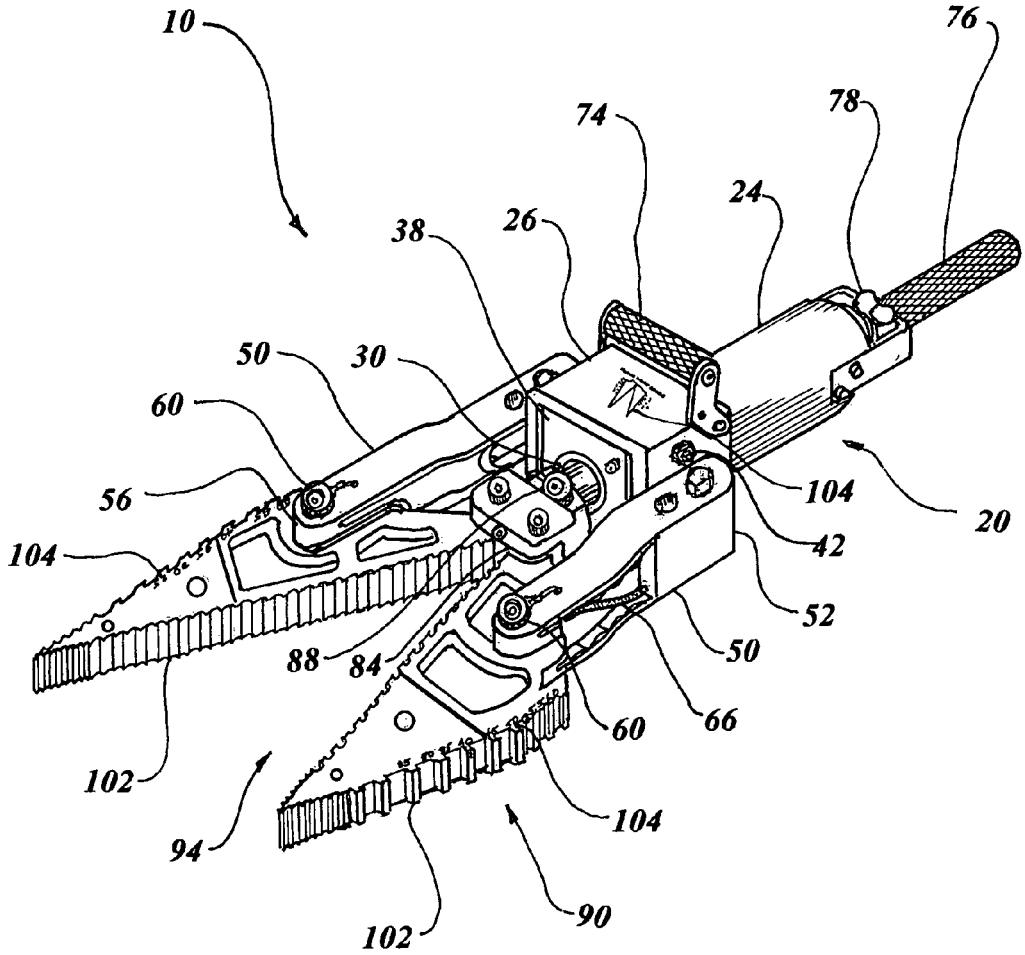
FIG. 1 is a partial isometric view of the first spreader arms embodiment.

The best mode for carrying out the invention of the hydraulic rescue tool 10 is presented in terms of two separate units: a unitary thrust apparatus 20 producing the energy to operate the tool and a quick disconnect implement unit 22 which includes a vehicle structural separating apparatus. The thrust apparatus 20 is exactly the same for all of the embodiments and is shown in FIGS. 1-14. There are seven distinct quick disconnect implement units 22, each having a different vehicle structural separating apparatus which are illustrated attached to the thrust apparatus 20 in the odd numbered FIGS. 1, 3, 5, 7, 9, 11 and 13 and are bracketed separately in the even numbered FIGS. 2, 4, 6, 8, 10, 12 and 14.

The same thrust apparatus 20 is used in conjunction with all of the various implement units 22 and is comprised of an interlocking unitized hydraulic cylinder body 24 having a hollow enlarged end 26 containing a mating pair of opposed slots 28 in each side of the enlarged end 26. The hydraulic cylinder body 24 is preferably made of a high grade aluminum alloy or other material such as titanium, metal matrix or carbon fiber, with the enlarged end 26 hollowed in a rectangular shape.

A piston rod 30 is disposed within the hydraulic cylinder body 24, with the rod 30 incorporating a sealing member 32 on the end enclosed in the hydraulic cylinder body 24. The piston rod 30 slideably extends from and retracts within the hydraulic cylinder body 24. The piston rod 30 is preferably constructed of steel and has a yoke attaching bore 34 in an end opposite the sealing member 32.

A pair interlocking ears 36 having a T-shape are disposed within the hydraulic cylinder body 24 hollow enlarged end 26, with a leg of the T protruding from each elongated slot 28 on the sides of the cylinder's enlarged end. The interlocking ears 36 are made of high tensile steel, stainless steel, titanium, fiber metal matrix, or high-strength light-weight carbon fiber, with heat treated steel preferred. The ears 36 are configured to interface with an inner surface of the hydraulic cylinder body 24 hollow enlarged end 26, with the ears 36 extending from the slots 28.

A gland 38 is interfaced between the interlocking ears 36 and locked in place with at least two fasteners, such as conventional pins and rivets, with gland attaching bolts 40 with nuts 42 preferred which penetrate completely through the gland 38 and both ears 36 onto the outer surfaces of the cylinder enlarged end 26. The gland 38 is basically an assembly consisting of a metallic body having a rectangular shape on the exposed end and round shape on the end interfacing with the cylinder bore. A number of seals are utilized, including a piston rod seal 44 that is installed on the inner surface of the gland 38 interfacing with the piston rod 30, a gland seal 46 that is positioned on the round end of the gland 38 engaging the cylinder body 24, and a rod wiper seal 48 that is positioned on the external side of the gland 38.

The configuration of the gland 38 permits removal of the entire assembly in the field with common tools for servicing the seals when the bolts 40, nuts 42, pins or rivets are removed which have jointly interlocked the ears 36 and the gland 38 within the hollow enlarged end of the cylinder body 26.

A connecting link 50 is attached on a first end 52 to each extending interlocking ear 36 and on a second end 54 to the vehicle structure separating apparatus 90. The connecting link 50 is offset in shape and is preferably of aluminum construction formed with a clevis 56 on each end. A central portion of each side is recessed forming an I-shape, with the upper and lower outer surface having finger gripping grooves 58 and the first end 52 forming an enclosed end which prevents finger pinching during manual handling of the rescue tool 10.

The second end 54 of the connecting link 50 is configured to receive a removable link pin 60 having a first self-contained LED 62 installed within its head. The removable link pin 60 has an adjustable ball detent 64 and a retractable spring-loaded link pin tether 66 attached to its head. The link pin tether 66 is always stored in tension in the hollow side of the link 50 and is retracted under compression of the spring, thereby permitting the link pin tether 66 to be concealed within the linkage when not in use.

The link pin tether 66 that preferably consists of wire rope 68 that is attached to a extension spring 70 on one end and looped around the link pin 60 on the other end, with the spring 70 housed in semi-flexible tubing 72. When the pin 60 is removed from the link 50 the spring 70 is extended, and when replaced the wire rope 68 is pulled back into the tubing 72 by the spring 70 to an at rest position within the tubing 72.

Handles are provided for lifting and operating the rescue tool 10 including a forward fold-down handle 74 which is attached to the enlarged end 26 of the hydraulic cylinder body 24. A rearward yieldable handle 76 is attached onto an end of the hydraulic cylinder body 24 opposite the enlarged end 26, with the handles 74 and 76 made from a material consisting of a coated metal, an insulation coated metal or an electrically non-conductive substance.

Hydraulic controls are attached to the cylinder body 24 for regulating hydraulic pressure. The hydraulic controls consist of an in and out directional control lever 78 for the hydraulic thrust mechanism 20 to manually select the piston rod 30 thrust and retraction position.

A reverse thrust pressure relief valve 80 is attached through the gland 38 and a forward thrust pressure relief valve 82 is positioned through the end of the cylinder body 24 to relieve excessive hydraulic pressure for safety protection.

The hydraulic thrust apparatus 20, as described above and illustrated bracketed in FIGS. 1, 3, 5, 7, 9 and 11, creates the necessary thrust or power to operate any number of attachments with dissimilar functional purposes that require a motivating force and hence the invention is not limited to the quick disconnect items described below.

The six discrete embodiments of the quick disconnect implement unit 22 that are optionally connected to the hydraulic thrust apparatus 20 complete the hydraulic tool 10. Each embodiment requires a yoke 84 with a yoke body 86 attached to the piston rod 30 and with a tethered yoke pin 88 and a vehicle structure separating apparatus 90 attached to the yoke 84.

The yoke 84 in all of its embodiments may optionally incorporate a second self-contained LED 92 attached to a visible portion of the yoke 84 to indicate the yoke's location in a vehicle or container when assembling the stored quick disconnect implement unit 22 to the hydraulic thrust apparatus 20.

Figure 2:
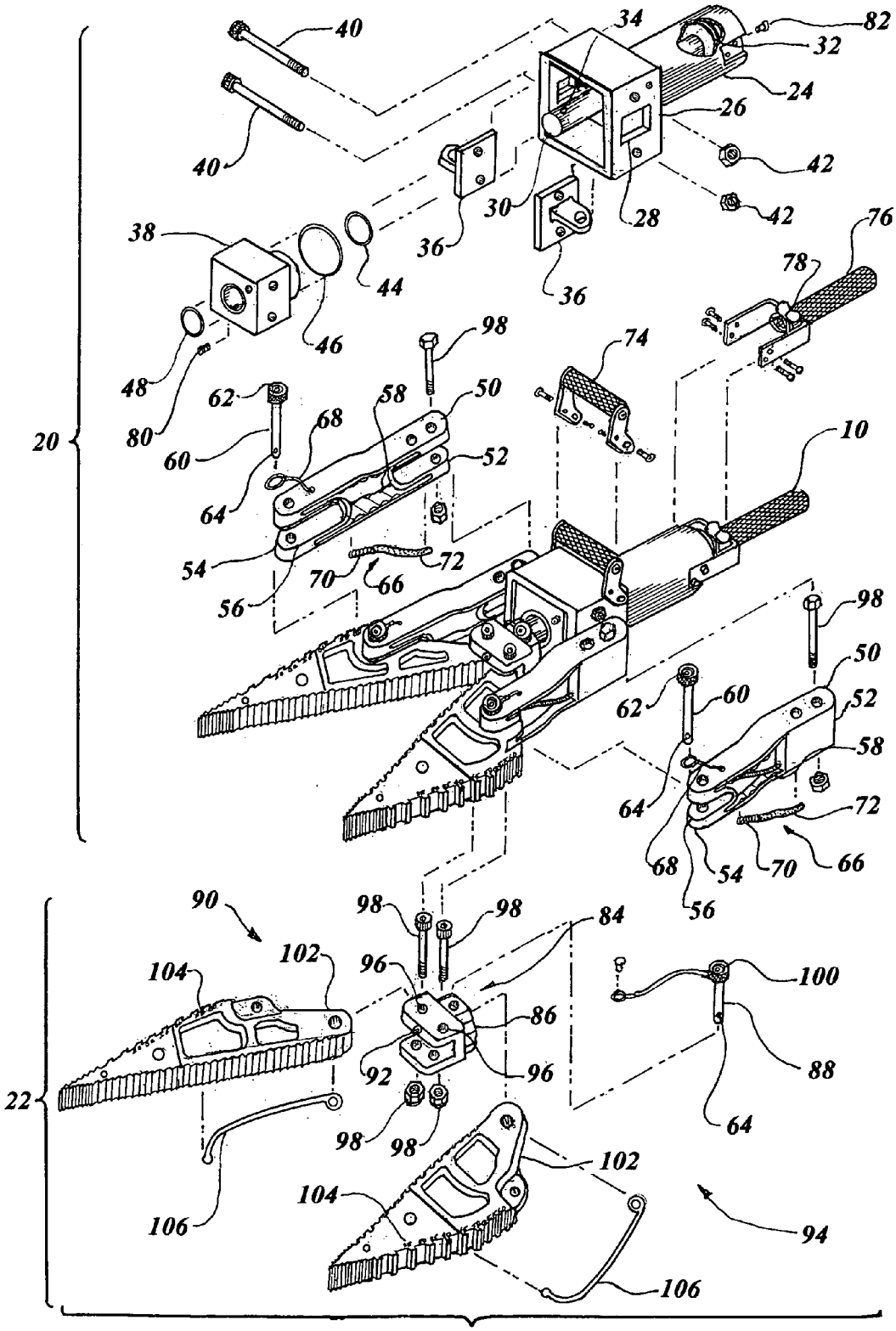
FIG. 2 is an exploded isometric view of the first embodiment.

The quick disconnect implement unit 22 in the first embodiment, as illustrated in FIGS. 1 and 2, is designated as the spreader arms embodiment 94. In this embodiment the yoke 84 is configured in a T-shape, which allows attachment of vehicle structure separating apparatus 90 with the tethered yoke pin 88. The yoke 84 is preferably a unitary steel construction, with the yoke 84 in a channel shape with two spreader arm holes 96 configured for attachment with threaded fasteners 98.

The tethered yoke pin 88 in this first spreader arms embodiment includes a third self-contained LED light 100 within a head portion of the pin 88 and an adjustable ball lock detent 64 on the distal end.

The vehicle structure separating apparatus 90 in the spreader arm embodiment 94 consists of a pair of opposed spreader arms 102 attached to the yoke 84 and also each connecting link 50. Each spreader arm 102 consists of a steel spreader member having full length teeth and annealed tips that are pinned and bonded to a spreader arm aluminum body.

The spreader arms 102 contain force load gauge indicia 104 on an exposed surface to indicate the amount of force available at a given point relative to a pivot point distance. Each arm 102 incorporates an internal energy absorbing member 106 disposed in a groove flush with an underside external surface. Alternately, the force load gauge indicia 104 may be etched, silk screened, stenciled or attached with a decal, name plate, or the like, to any part of the hydraulic rescue tool 10 displaying the same information, as illustrated in FIG. 1. The energy absorbing member 106 is preferably constructed of flat malleable mild steel welded in place on an exposed underside surface of each spreader arm 102.

Figure 3:
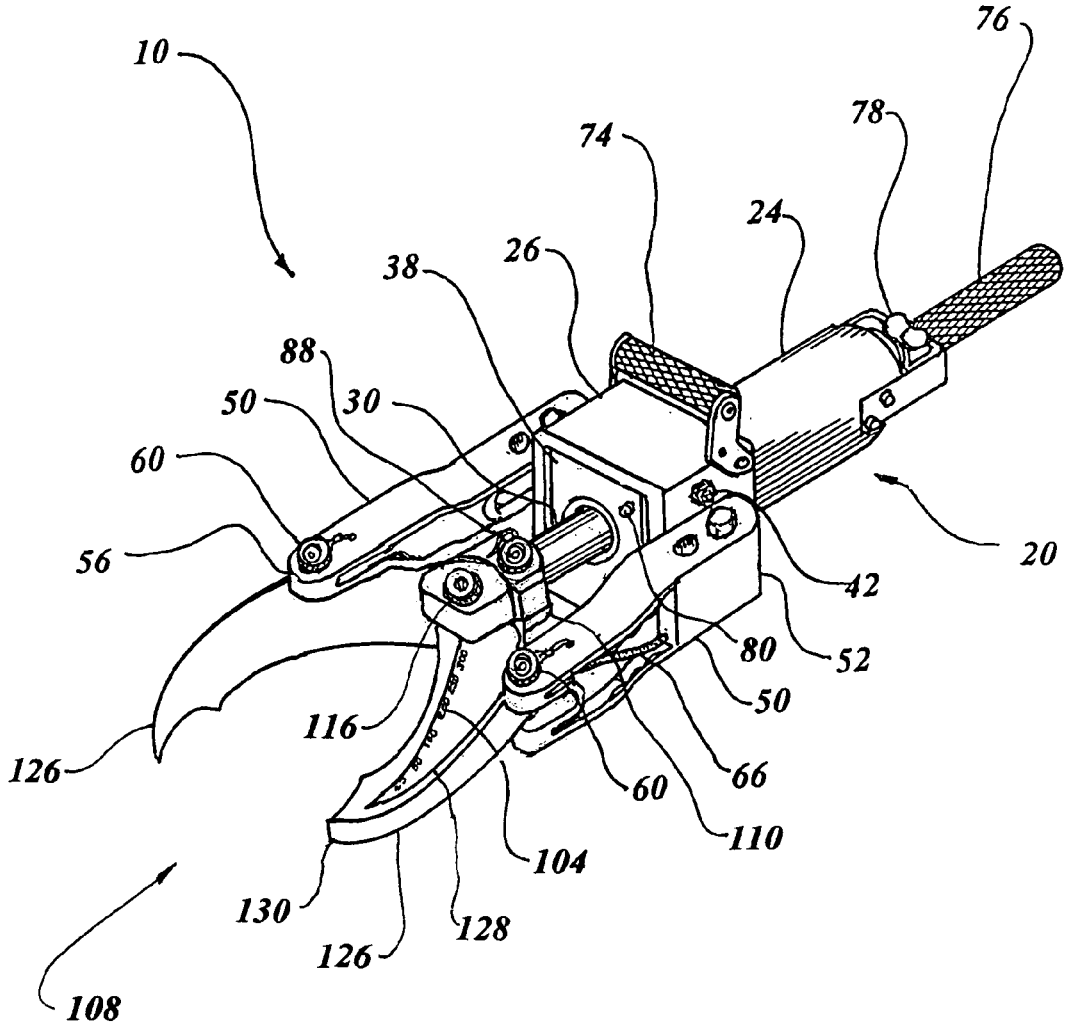
FIG. 3 is a partial isometric view of the second cutter jaws embodiment.
Figure 4:
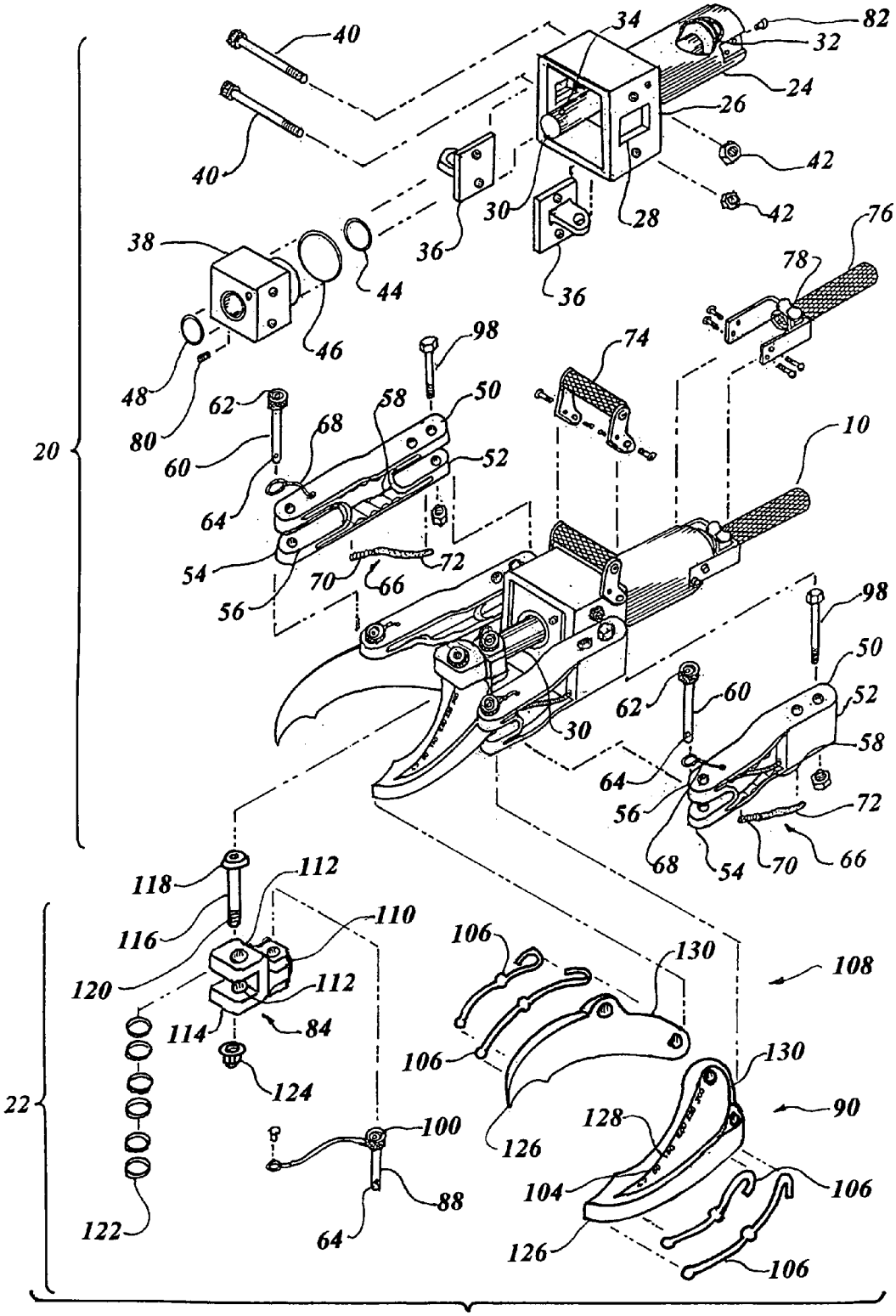
FIG. 4 is an exploded isometric view of the second embodiment.

The quick disconnect implement unit 22 in the second embodiment, as illustrated in FIGS. 3 and 4, is designated as the cutter jaws embodiment 108. In this embodiment the yoke 84 is configured as a C-shaped yoke 110 having two mating through-holes 112, thereby allowing attachment of the piston rod 30 to the vehicle structure separating apparatus 90. The C-shaped yoke 110 incorporates a recessed register 114 adjacent to the bottom through-hole 112, with a shoulder bolt 116 having a head 118 on a first end and threads 120 on a second end, disposed within the through-holes 112. A plurality of flat bearings 122 are disposed between the yoke 110 and the cutting blades, and a flanged nut 124 attached to the shoulder bolt on the threaded end. The flange of the nut 124 interfaces with the recessed register 114 of the yoke 110 providing a space that permits a preload, thereby allows each cutting blade to move freely without binding yet sufficiently close to cut cleanly.

The tethered yoke pin 88 in this cutter jaws embodiment 108 includes a self-contained third LED 100 within a head portion of the pin 88 and an adjustable ball lock detent 64 on the opposite end.

The vehicle structure separating apparatus 90 specifically consists of a pair of cutting blades 126 with each cutting blade 126 having a top member 128 and a bottom member 130. The two members 128, 130 are attached together to form a double thick blade with the top member 128 smaller than the bottom member 130 and the bottom member 130 having an annealed tip. Each member incorporates an internal energy absorbing member 106 disposed flush on an underside surface. The internal energy absorbing member 106 is constructed of flat malleable mild steel, welded in place on an interface surface to the one of the members 128 and 130. The double thick cutting blades 126 engage together in mirror image sets such that the bottom members 130 engage contiguously.

Force load gauge indicia 104 may be located on an exposed surface of the blades 126 or tool 10 to indicate the amount of force available at a given point relative to the pivot point distance.

Figure 5:
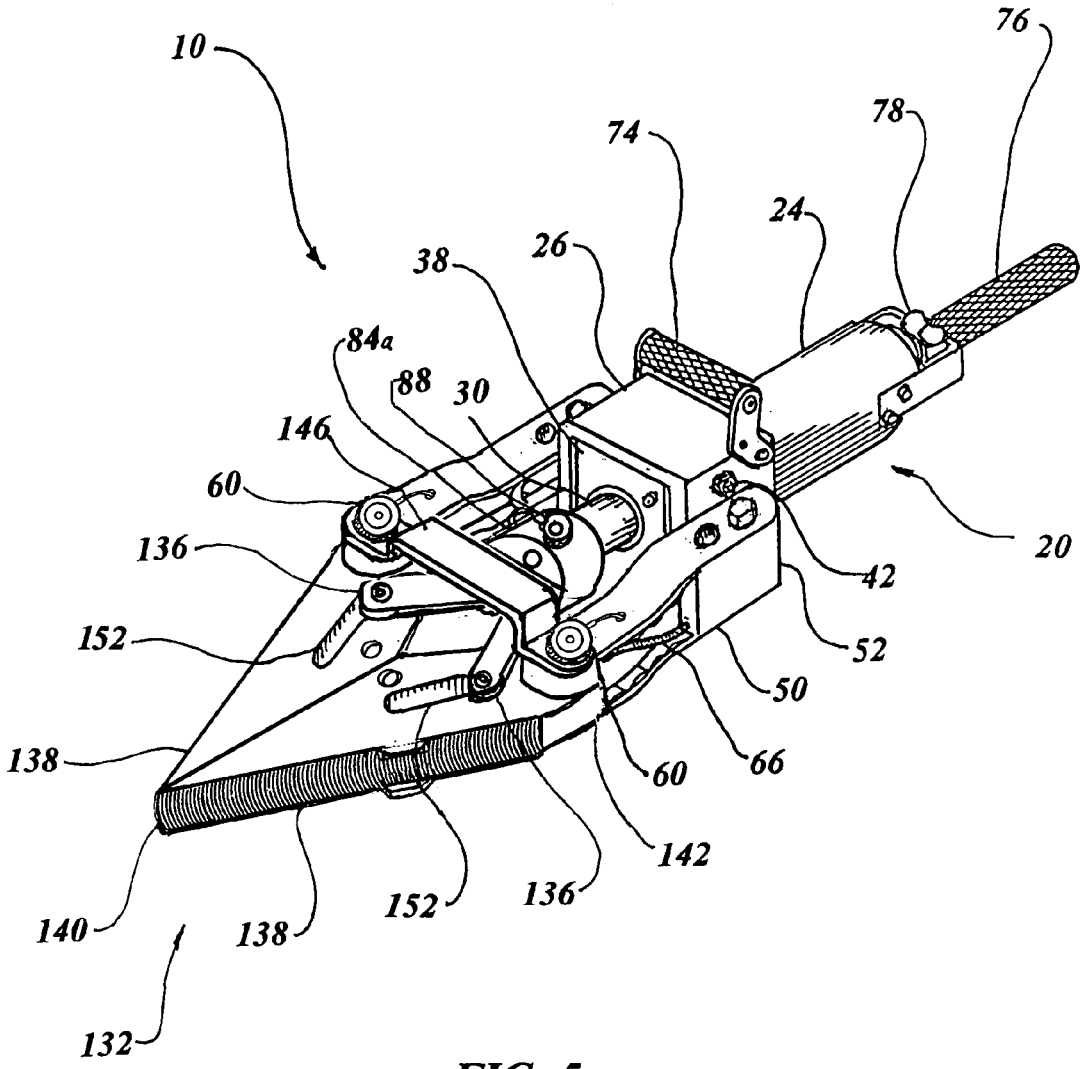
FIG. 5 is a partial isometric view of the third two stage mechanical apparatus embodiment.
Figure 6:
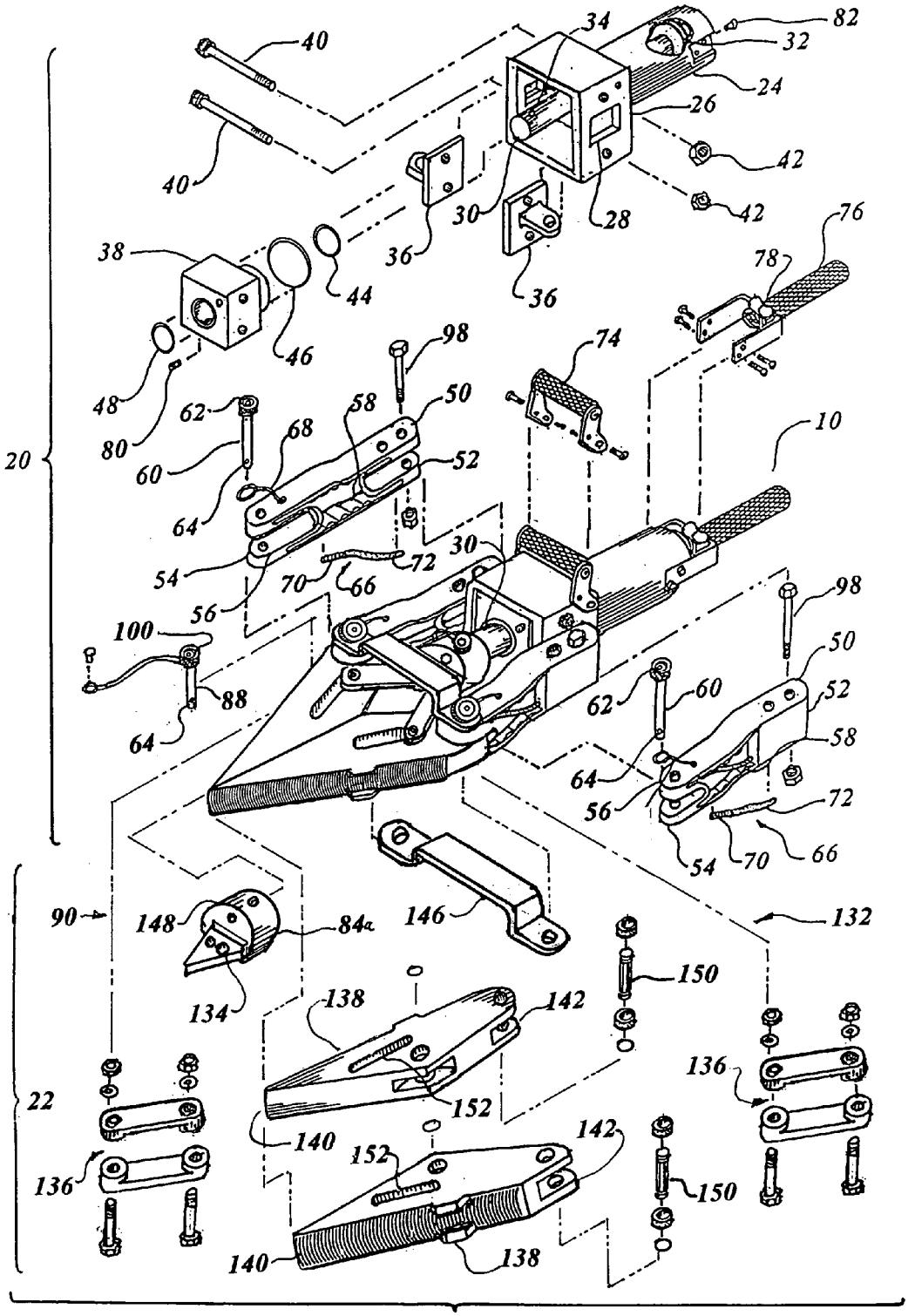
FIG. 6 is an exploded isometric view of the third embodiment.

The quick disconnect implement unit 22 in the third embodiment, as illustrated in FIGS. 5 and 6, is designated as the two stage mechanical apparatus embodiment 132. In this embodiment the yoke 84 is configured to form a pusher cam 84*a*, as well as a yoke with the pusher cam yoke 84*a* having two mating through-holes 134 for attachment to a plurality of linkages 136.

The tethered yoke pin 88 incorporates a third self-contained LED light 100 within a head portion of the pin 88 and a ball lock detent 64 is positioned on the pin's opposite end.

The vehicle structure separating apparatus 90 consists of a pair of opposed spreader arms 138, with each arm having a first end 140 and a second end 142. Each second end 142 is pivotally attached to each connecting link 50, with a bridge 146 attaching each pair of spreader arms 138 together and held captive with the removable link pins 60 such that each spreader arm 138 is free to swivel.

The pusher cam yoke 84*a* has a triangular shaped body with triangular surfaces contiguously engaging opposed spreader arms 138. The pusher cam yoke 84*a* is integrally formed with a cylindrical shank 148 for attachment to the piston rod 30 which is disposed within the hydraulic cylinder body 24.

Each spreader arm 138 includes rollers 150 that are configured to interface with the pusher cam yoke 84*a* defining an initial thrust mode and each spreader arm 138 includes a slot 152 providing an attachment opening for the linkages 136 when axially spreading the arms 138 apart, thereby producing a secondary thrust of the tool. The linkages 136 are configured as toggle links, each having a rectangular shape with raised bosses on one side at opposed ends and are configured to penetrate and slide within the slot 152 in each spreader arm 138 and are attached to the yoke mating through-holes 134.

Figure 7:
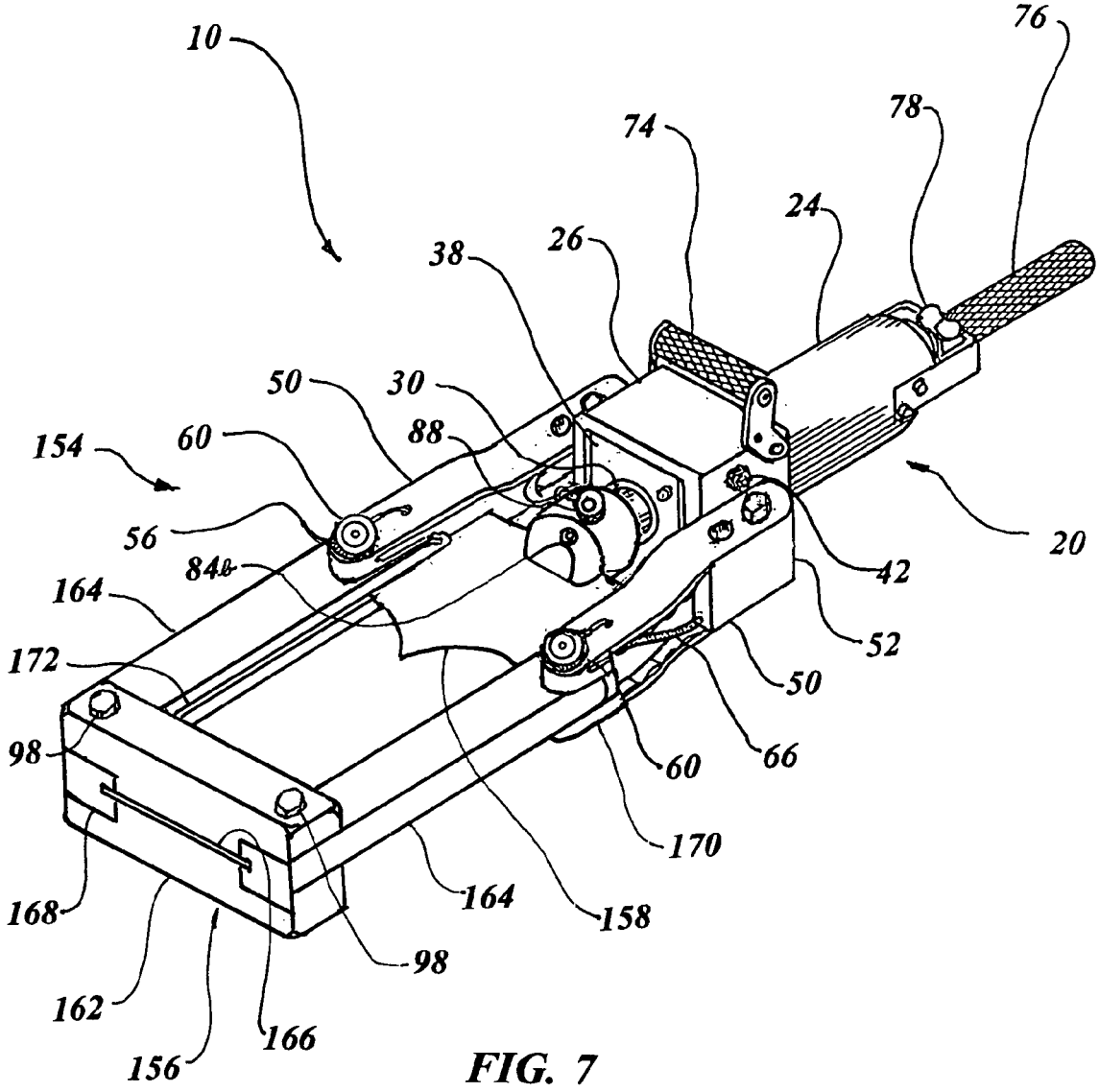
FIG. 7 is a partial isometric view of the fourth pipe and structural head embodiment.
Figure 8:
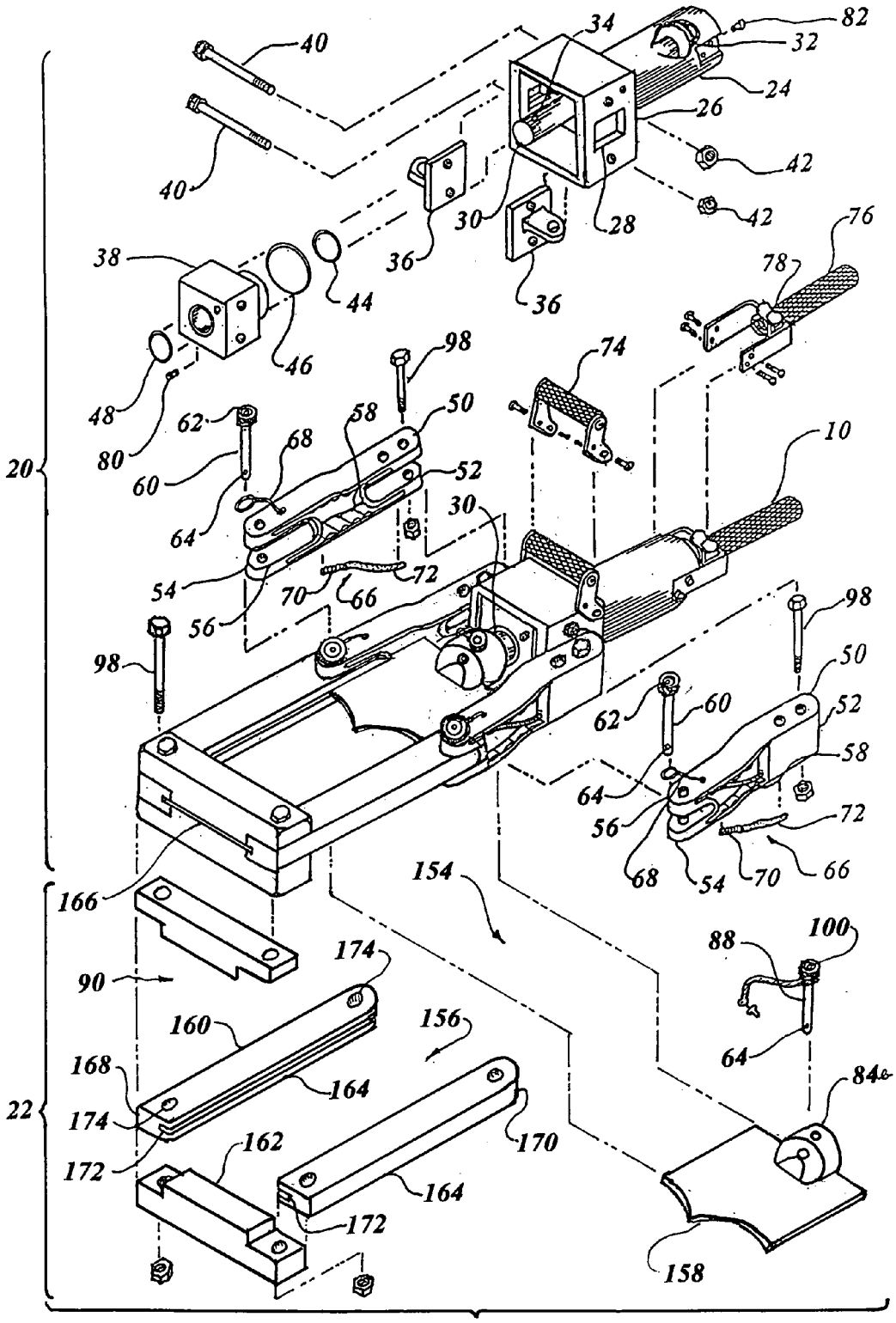
FIG. 8 is an exploded isometric view of the fourth embodiment.

The quick disconnect implement unit 22 in the fourth embodiment, as illustrated in FIGS. 7 and 8, is designated as the pipe and structural head embodiment 154. In this embodiment the yoke 84 is configured with a hub and an integral blade 84*b* and is attached directly to the piston rod 30. The tethered yoke pin 88 in this embodiment 154 includes a self-contained third LED 100 within a head portion of the pin 88 and an adjustable ball lock detent 64 on the distal end.

The vehicle structure separating apparatus 90 consists of a slotted stop 156 that is aligned with the integral blade 84*b* of the hub, when the blade is urged within the slot of the stop 156 a severing action occurs such as that created by a guillotine. The yoke with the hub and integral blade 84*b* is preferably a unitary steel construction, with the hub of the yoke 84 attached to the piston rod 30 with the tethered yoke pin 88. The blade of the yoke 84 has a radially offset crescent-shaped point 158 protruding from a straight edge, with both the point and straight edge having a sharp edge.

The slotted stop 156 consists of a notched top member 160, a notched bottom member 162 and two grooved stop extension arms 164. The extension arms 164 are attached with threaded fasteners 98 on each notch of the top member 160 and each notch of the bottom member 162, leaving a slot 166 therebetween.

Each extension arm 164 is preferably in the shape of a bar with a first end 168, a second end 170 and sides, and the extension arm 164 incorporates a longitudinal groove 172 extending the full length of at least one side. Each extension arm has a bolt hole 174 on the first end 168 and the second end 170 is configured to fit into the clevis end 56 of the connecting link 50. The extension arm first end 168 interfaces with notches in the notched top member 160 and the notched bottom member 162, as illustrated in FIG. 7, and attaches with threaded fasteners 98.

Figure 9:
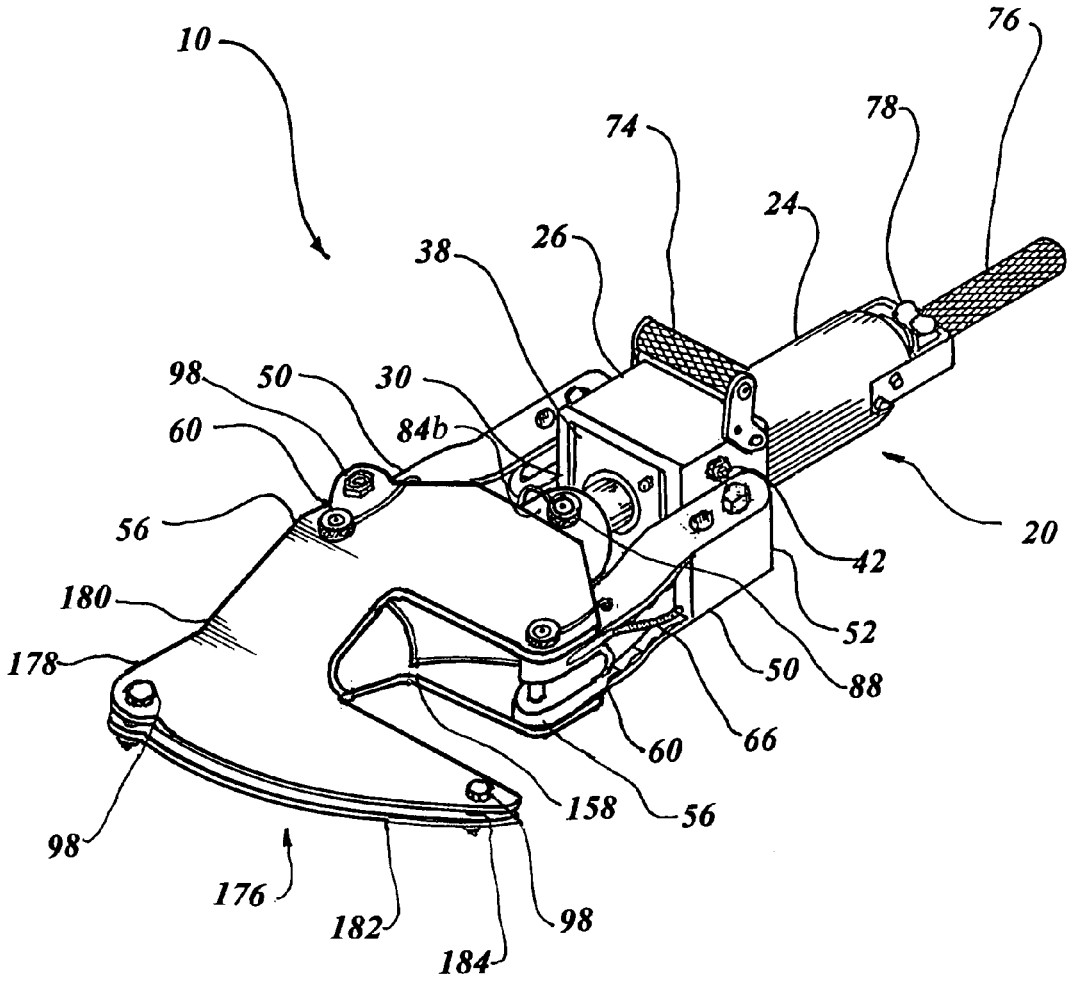
FIG. 9 is a partial isometric view of the fifth guillotine head embodiment.
Figure 10:
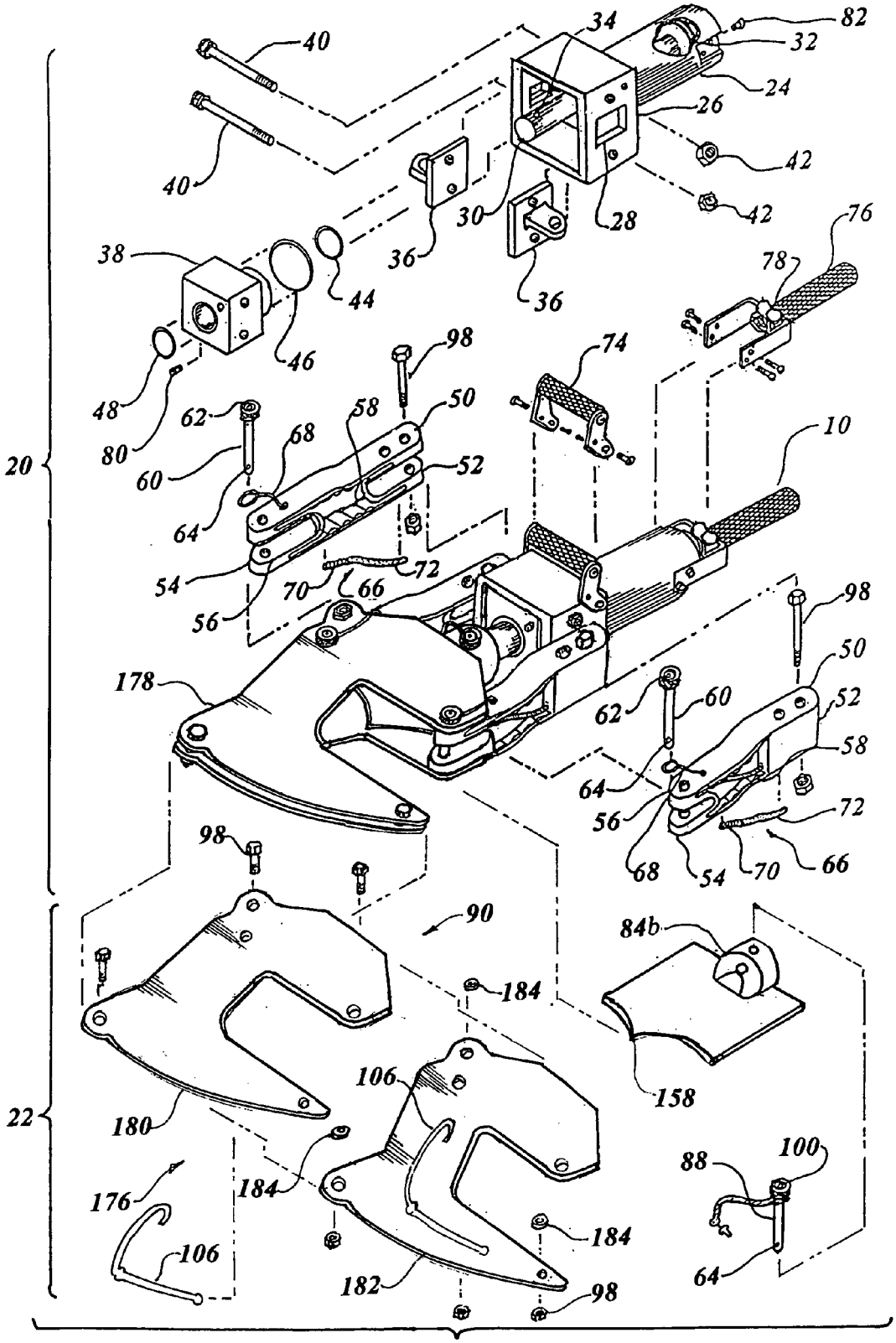
FIG. 10 is an exploded isometric view of the fifth embodiment.

The quick disconnect implement unit 22 in the fifth embodiment, as illustrated in FIGS. 9 and 10, is designated as the guillotine head embodiment 176. In this embodiment the yoke 84 is configured with a hub and an integral blade 84*h* with the hub attached to the piston rod 30. The tethered yoke pin 88 in this embodiment 176 includes a self-contained third LED light 100 within a head portion of the pin 88 and an adjustable ball lock detent 64 on the distal end.

The vehicle structure separating apparatus 90 consists of a slotted C-shaped jaw 178 configured to receive the blade 84*b*. When the blade 84*b* is urged within the jaw slot a severing action occurs such as that created by a guillotine.

The yoke with a hub and integral blade 84*b* is preferably a unitary steel construction, with the hub of the yoke 84*b* attached to the piston rod 30 with the tethered yoke pin 88. The blade of the yoke 84*b* has a radially offset crescent-shaped point 158 protruding from a straight edge with both the point and straight edge having a sharp edge.

The slotted C-shaped jaw is preferably made with an offset tapered top plate 180, and a tapered bottom plate 182 in mirror image of each other. The top plate 180 and bottom plate 182 contiguously engage together with jaw spacers 184 and the C-shaped jaw 178 is configured to permit the hub of the yoke 84 to penetrate therethrough. The C-shaped jaw 178 is attached to the connecting links 50 of the hydraulic thrust apparatus 20 on the top and bottom of the clevis end 56.

The top plate 180 and the bottom plate 182 each include an internal energy absorbing member 106 constructed of flat malleable mild steel, which is welded in place on an exposed internal surface facing each other.

Figure 11:
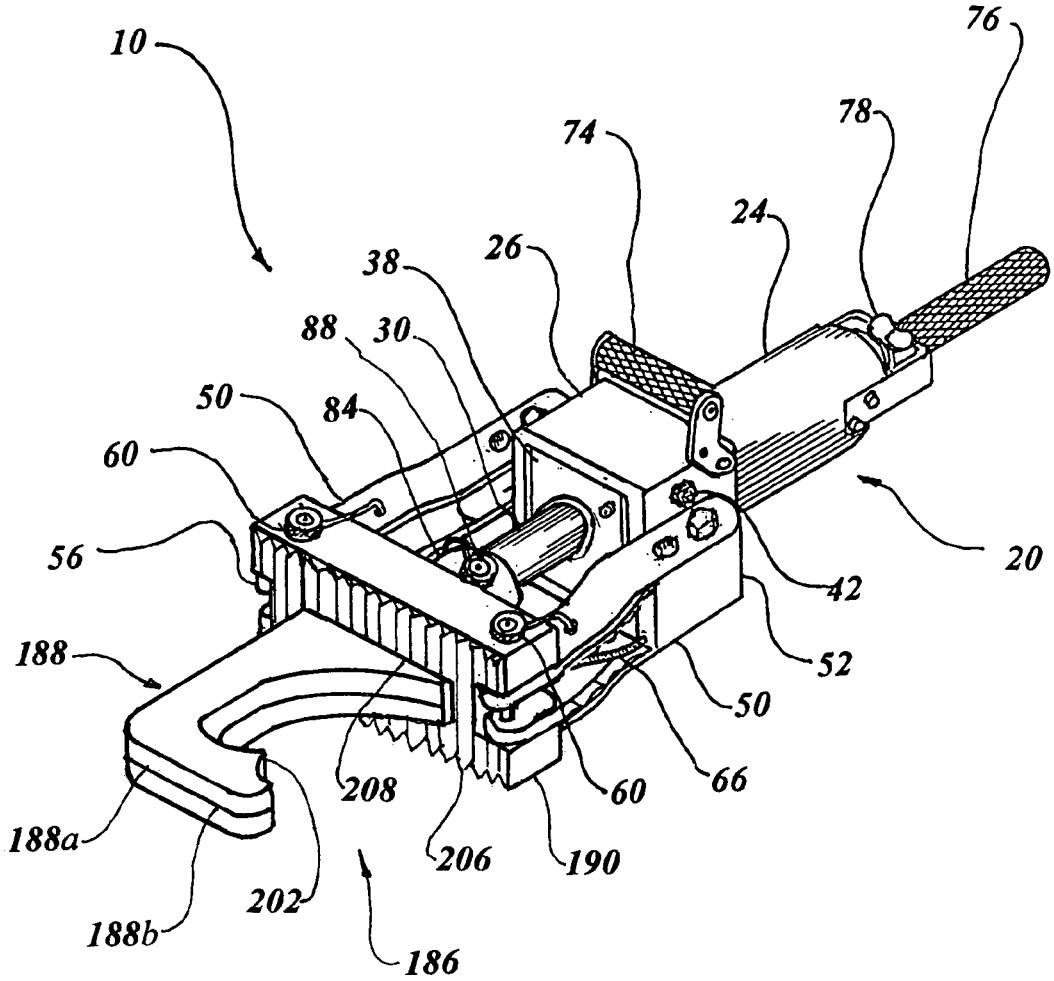
FIG. 11 is a partial isometric view of the sixth reverse cutting guillotine head embodiment.
Figure 12:
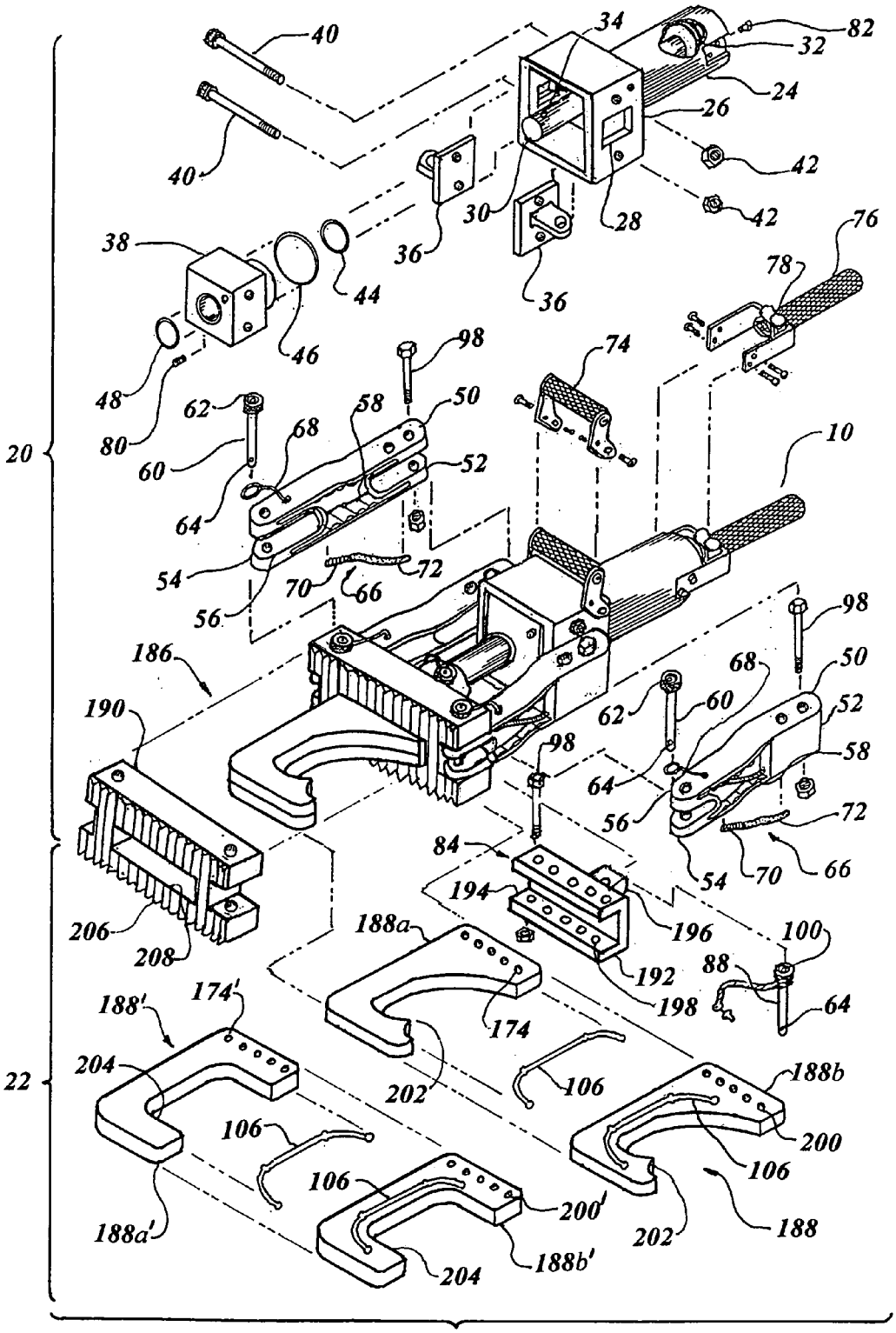
FIG. 12 is an exploded isometric view of the sixth embodiment.

The quick disconnect implement unit 22 in the sixth embodiment, as illustrated in FIGS. 11 and 12, is designated as the reverse cutting guillotine head 186. In this embodiment the yoke 84 is connected to the piston rod 30 and a hooked blade 188 is attached to the yoke 84. A slotted barrier block 190 is configured to permit the hooked blade 188 to pass through when the hook end of the blade 188 surrounds a workpiece and is pulled into the slotted barrier block 190, a severing action occurs such as that created by a guillotine.

The yoke 84 is configured with unitary steel construction with a flattened hub attached to the piston rod 30. The tethered yoke pin 88 has a self-contained third LED light 100 within a head portion of the pin 88 and an adjustable ball lock detent 64 on the distal end.

The yoke 84 in this embodiment is different than the previous embodiments in that it is specifically designated as a blade containing yoke 192 configured with an integral elongated channel-shaped blade retainer 194 that is integrally formed in a flattened hub 196. The blade retainer 194 includes a number of blade connecting through-holes 198 for retaining the hooked blade 188 with threaded fasteners 98.

The hooked blade 188 is formed of two discreet flat blade body members 188*a* and 188*b* that are juxtapositioned together, as illustrated in FIG. 12. Each blade member incorporates a number of bolt holes 174 in a first end and a second end configured in a hook shape with a radially offset crescent-shaped sharp edge 202 adjacent to the distal end. An alternate configuration of the hooked blade 188', as illustrated in FIG. 12, utilizes a flat right angular hook shape 204 for crimping or crushing.

In either case an internal energy absorbing member 106 is disposed in a groove flush with a mating surface on each discreet flat blade body member 188*a* and 188*b*. The energy absorbing member 106 is preferably constructed of flat malleable mild steel that is welded in place. The plurality of fasteners 98 attach the blade body to the yoke.

The slotted barrier block 190 consists of a rectangular body having gripping teeth 206 formed in the front surface of the body with a centrally located blade slot 208 therethrough that is configured to provide a slide fit for the blade 188. The barrier block 190 is also configured on each side to interface with the connecting links 50 with the removable link pins 60.

Figure 13:
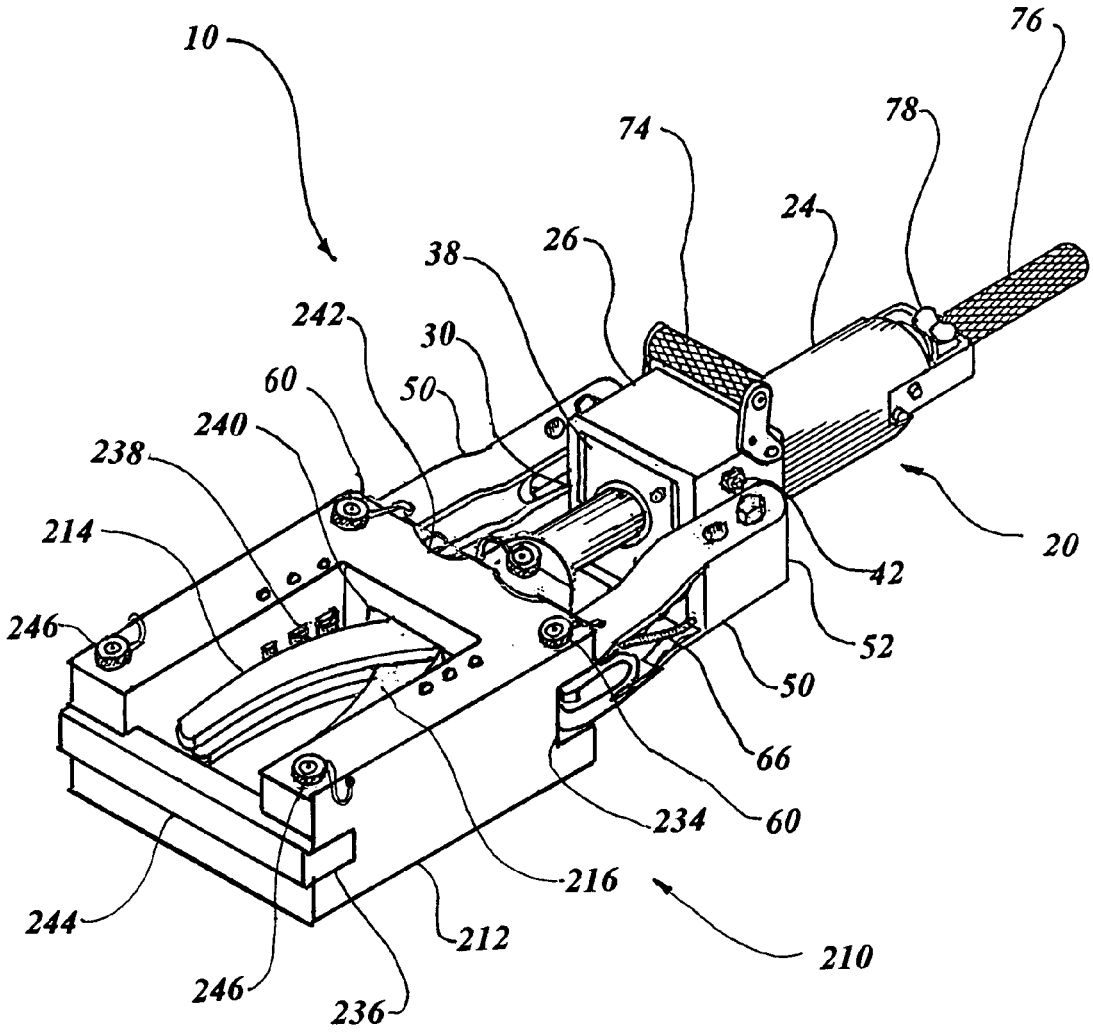
FIG. 13 is a partial isometric view of the seventh cam cutter embodiment.
Figure 14:
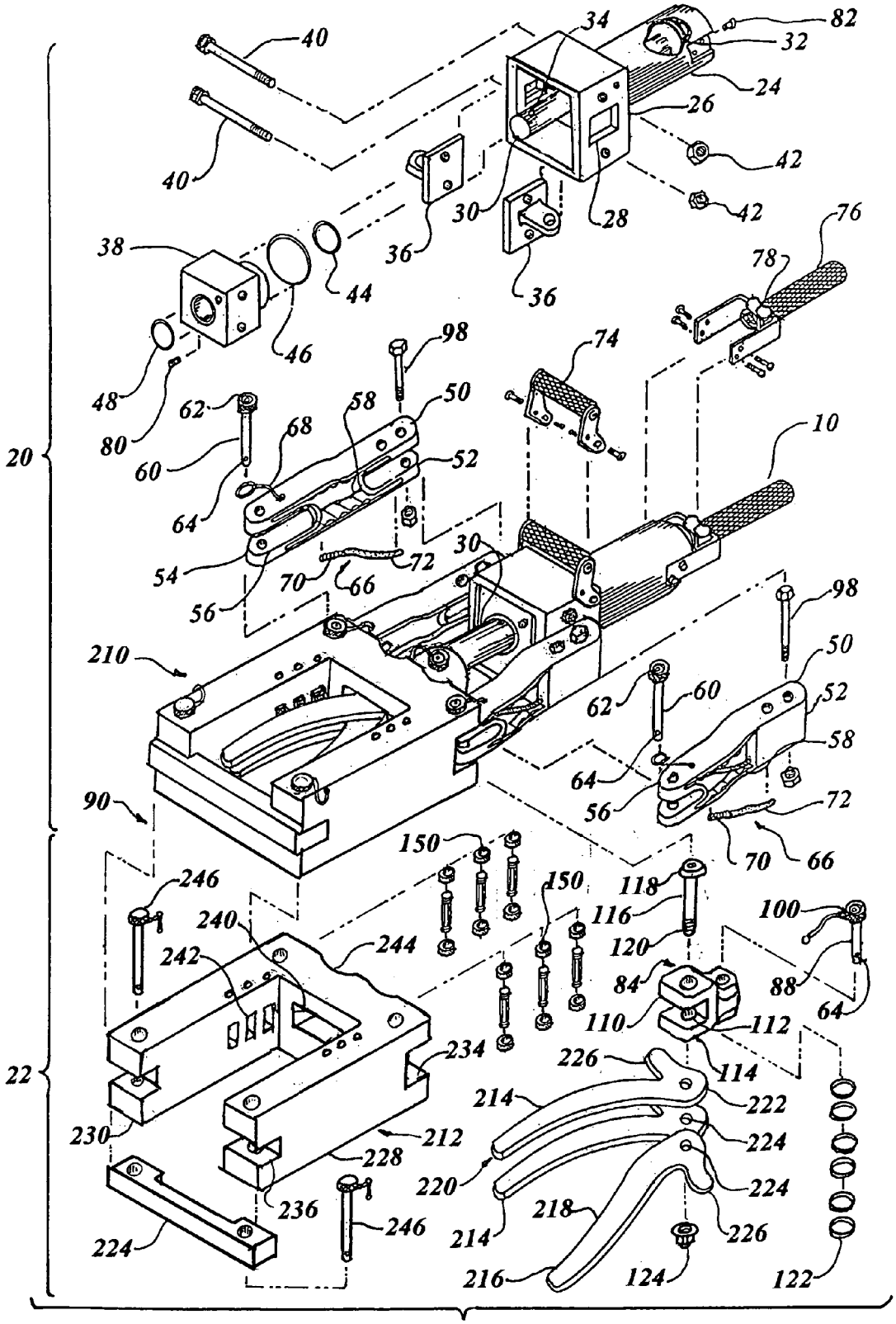
FIG. 14 is an exploded isometric view of the seventh embodiment.

The quick disconnect implement unit 22 in the seventh embodiment, as illustrated in FIGS. 13 and 14, is designated as the cam cutter 210. In this cam cutter embodiment the 210 the yoke 84 is configured as a C-shaped yoke 110 having two in-line through-holes 112, allowing attachment of the vehicle structure separating apparatus 90 to the piston rod 30.

The vehicle structure separating apparatus 90 incorporates a U-shaped jaw 212 and a pair of compression arms 214 separated by a cutting blade 216 extending within the U-shaped jaw 212.

The C-shaped yoke 110 incorporates a recessed register 114 adjacent to the bottom through-hole 112, with a shoulder bolt 116 having a head 118 on a first end and threads 120 on a second end, disposed within the through-holes 112. A plurality of flat bearings 122 are disposed between the yoke 110 and the compression arms, also a plurality of flat bearings 122 are disposed between the compression arm 214 and the cutting blade 216. A flanged nut 124 is attached to the shoulder bolt 116 on the threaded end. The flange of the nut 124 interfaces with the recessed register 114 of the yoke 110 providing a space that permits a preload, thereby allows each compression arm 214 and the cutting blade 216 to move freely without binding, yet sufficiently close to cut cleanly.

The tethered yoke pin 88 includes a third self contained LED 100 within the head portion of the pin 88 and an adjustable ball lock detent 64 on the opposite end of the pin 88.

The compression arms 214 preferably have a crescent shaped inner edge and a contoured outer edge adjacent to an interface with said U-shaped jaw 212. The cutting blade 216 preferably has a configuration in mirror image of the compression arms 214 with an edge penetrating the compression arms 214 having a sharp cutting edge 218 permitting the cutting blade 216 to penetrate and sever a workpiece when the arms 214 and blade 216 are pulled together by the hydraulic thrust apparatus 20.

The compression arms 214 have a front end 220 and a rear end 222 with the front end 220 penetrating through the U-shaped jaw 212 and extending therein with the rear end 222 having a yoke hole 224 for connecting to the shoulder bolt 116 disposed within the yoke in-line through-holes 112. A caming projection 226 is integrally formed and extends outward from the yoke hole 224 for caming the arms 214 together when the yoke 110 is extended from the hydraulic thrust apparatus 20 with the caming projections 226 interfacing with the U-shaped jaw 212.

The cutting blade 216 also has the same front end 220 and rear end 222 with the front end 220 penetrating through the U-shaped jaw 212 and extending therein. The rear end 222 also has a yoke hole 224 for connecting to the shoulder bolt 216. A caming projection 226 also extends outwardly from the yoke hole 224 caming the cutting blade in like manner as the compression arms 214.

The U-shaped jaw 212 is formed with a jaw body 228 which has a front end 230 and a rear end 232 which faces the hydraulic thrust apparatus 20.

The jaw body 228 incorporates the following features: a connecting link notch 234 on each rear end corner, a front end latch groove 236 through the front end, a plurality of side roller recess opening 238, an arm and blade slot 240 completely through the rear end, and a caming recess 242 in the rear end interfacing with each caming projection 226 on the compression arms 214 and cutting blade 216.

A roller pin 150 captivated by a pair of oil impregnated bushings is pressed into each side roller recess opening 238 in the U-shaped jaw 212 with each roller pin 150 having a groove adjacent to each end with a snap ring disposed within each groove for retention of the pin 150 within the U-shaped jaw 212.

A detachable latch 244 disposed within each U-shaped jaw front end latch groove 236 for strengthening the jaw's open end, with the latch 244 attached through the jaw 212 with a number of tethered quick release latch pins 246.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A hydraulic rescue tool comprising:

a) a hydraulic thrust apparatus comprising:

(1) an interlocking hydraulic cylinder body having a hollow end having at least two slots therethrough, (2) a piston rod disposed within said cylinder body, said rod having a sealing member slideably affixed thereupon with said rod extending from the cylinder body, (3) at least two interlocking ears disposed within the hollow end of the cylinder body and penetrating through the at least two slots, (4) a gland interfaced between said interlocking ears, with said gland having at least two fasteners penetrating the gland, jointly interlocking said ears to said gland within the hollow end of the cylinder body, b) a connecting link attached to each interlocking ear, and c) a quick disconnect implement unit attached to said piston rod and said links for vehicle structure separating.

2. A hydraulic rescue tool comprising:

a) a hydraulic thrust apparatus comprising:

(1) an interlocking unitized hydraulic cylinder body having a hollow enlarged end with a mating pair of slots therethrough, (2) a piston rod disposed within said hydraulic cylinder body, said rod having a sealing member affixed thereupon, said rod slideably extending and retracing from the cylinder body, (3) a pair interlocking ears disposed within the hollow enlarged end of the cylinder body penetrating through the elongated slots, (4) a gland interfaced between said interlocking ears, with said gland having a plurality of seals and at least two fasteners penetrating the gland, jointly interlocking the ears and gland within the hollow enlarged end of the cylinder body, (5) a connecting link attached to each interlocking ear, (6) a plurality of handles attached to the cylinder body for lifting and operating the rescue tool, and (7) hydraulic controls attached to the cylinder body for regulating hydraulic pressure within the cylinder body, b) a quick disconnect implement unit attached to said hydraulic thrust apparatus having:

(1) a yoke with a yoke body attached to the piston rod with a tethered yoke quick release pin, and (2) a vehicle structure separating apparatus attached to said yoke.

3. The hydraulic rescue tool as recited in claim 2 wherein said hydraulic cylinder body is made of a construction material selected from the group consisting of aluminum, titanium, metal matrix and carbon fiber.

4. The hydraulic rescue tool as recited in claim 2 wherein the hollow enlarged end of the cylinder body has a rectangular shape.

5. The hydraulic rescue tool as recited in claim 2 wherein said piston rod disposed within said hydraulic cylinder body comprises a steel construction with said piston rod having a yoke attaching bore in an end opposite the sealing member.

6. The hydraulic rescue tool as recited in claim 2 wherein said interlocking ears is made of a material selected from the group consisting of heat treated steel, high tensile steel stainless steel, fiber metal matrix, high strength light weight carbon fiber and titanium inner surface of the cylinder body hollow enlarged end with the ears extending from the slots.

7. The hydraulic rescue tool as recited in claim 2 wherein said interlocking ears are configured to interface with an inner surface of the hollow enlarged end of the cylinder body with ears extending from the slots.

8. The hydraulic rescue tool as recited in claim 2 wherein said gland having a plurality of seals further comprising a rod seal disposed on an inner surface of the gland and interfacing with the piston rod, a gland seal on the outer surface and interlacing with the cylinder body and a wiper seal on the outer surface of the gland and interfacing with the piston rod.

9. The hydraulic rescue tool as recited in claim 2 wherein said gland having at least two fasteners that are selected from the group consisting of bolts and nuts, pins and rivets.

10. The hydraulic rescue tool as recited in claim 9 wherein said gland is configured to be removable in the field with common tools for servicing the seals when the bolts and nuts, pins or rivets are removed which have jointly interlocked the ears and the gland within said hollow enlarged end of the cylinder body.

11. The hydraulic rescue tool as recited in claim 2 wherein said connecting links further comprise an offset aluminum construction formed with a clevis portion on each end and a central portion recessed on each side, thereby forming an I-shape with an upper and lower outer surface having finger gripping grooves therein and an enclosed end portion adjacent to the interlocking ears preventing finger pinching during manual handling of said rescue tool.

12. The hydraulic rescue tool as recited in claim 2 wherein each connecting link further comprises a removable link pin having a first self-contained LED within a head portion thereof, with each removable link pin having a ball detent and a retractable spring-loaded tether attached thereunto, such that the link pin tether is always stored in tension in a hollow side of the link and is retracted under compression of the spring, thereby permitting the link pin tether to be concealed within the connecting link when not in use.

13. The hydraulic rescue tool as recited in claim 2 wherein said plurality of handles further comprise a forward fold-down handle that is attached to the enlarged end of the hydraulic cylinder body and a rearward yieldable handle attached onto an end of the hydraulic cylinder body opposite the enlarged end, with said forward fold-down handle and said rearward yieldable handle made from a material selected from the group consisting of a coated metal, an insulation coated metal and an electrically non-conductive substance.

14. The hydraulic rescue tool as recited in claim 2 wherein said hydraulic controls further comprises:

a) an in and out directional control lever that permits the hydraulic thrust mechanism to manually select the piston rod thrust and retraction position, and b) a reverse thrust pressure relief valve positioned on the gland and a forward thrust pressure relief valve positioned on the cylinder body for relieving excessive hydraulic pressure which provides safety protection.

15. The hydraulic rescue tool as recited in claim 2 wherein said yoke further comprises a second LED that is attached to a visible portion of the yoke to indicate the yoke's location when changing a stored quick disconnect implement unit to the hydraulic thrust apparatus.

16. The hydraulic rescue tool as recited in claim 2 wherein said quick disconnect implement unit is defined as a spreader arms embodiment which comprises:

a) said yoke configured in a T-shape, thereby allowing attachment to said vehicle structure separating apparatus with a tethered yoke pin, and b) said vehicle structure separating apparatus having a pair of opposed spreader arms attached to said yoke and said connecting link.

17. The hydraulic rescue tool as recited in claim 16 wherein said yoke configured in a T-shape further comprises a unitary steel construction, with said yoke having two spreader arm holes therethrough configured for attachment of each spreader arm with a threaded fastener, and said tethered yoke pin having a third LED light within a head portion of the pin and an adjustable ball lock on a distal end.

18. The hydraulic rescue tool as recited in claim 16 wherein each spreader arm further comprises a steel spreader member having full length teeth and annealed tips, pinned and bonded to a spreader arm aluminum body and said spreader arms each contain force load gauge indicia on an exposed surface to indicate the amount of force available at a given point relative to a pivot point distance.

19. The hydraulic rescue tool as recited in claim 16 further comprising force load gauge indicia added to any exposed surface of the tool to indicate the amount of force available at a given point relative to a pivot point distance.

20. The hydraulic rescue tool as recited in claim 16 further comprising a spreader arm internal energy absorbing member disposed within each spreader arm, with each spreader arm internal energy absorbing member constructed of flat malleable mild steel, and welded in place on an exposed underside surface of each spreader arm.

21. The hydraulic rescue tool as recited in claim 2 wherein said implement unit is defined as a cutter jaws embodiment which comprises:

a) said yoke configured as a C-shaped yoke having two mating through-holes, said yoke allowing attachment of said vehicle structure separating apparatus to said piston rod, and b) said vehicle structure separating apparatus having of a pair of cutting blades.

22. The hydraulic rescue tool as recited in claim 21 wherein said C-shaped yoke further comprises:

a) a recessed register adjacent to the first through-hole, b) a shoulder bolt disposed within the through-holes, with said shoulder bolt having a head on a first end and threads on a second end, c) a plurality of flat bearings disposed between the yoke and the cutting blades, and d) a flanged nut attached to the shoulder bolt on the threaded end, with the flange of the nut interfacing with the recessed register permitting a preload, thus allowing each cutting blade to move freely without binding yet sufficiently close to cut cleanly, and e) said tethered yoke pin having a third LED within a head portion of the pin and an adjustable ball lock detent on the opposite end thereof.

23. The hydraulic rescue tool as recited in claim 21 wherein said pair of cutting blades further comprise:

a) each cutting blade having a top member and a bottom member attached together forming a double thick blade, with the top member smaller than the bottom member and the bottom member having an annealed tip, b) each cutting blade top member having an internal energy absorbing member disposed flush with the underside surface, and each bottom member having an internal energy absorbing member disposed flush with a top surface, c) each cuffing blade internal energy absorbing member is constructed of flat malleable mild steel, welded in place on an exposed interface surface;

d) each double thick blade engages together in mirror image sets such that the bottom members engage contiguously; and e) each double thick cutting blade contains force load gauge indicia on an exposed surface to indicate the amount of force available at a given point relative to a pivot point distance.

24. The hydraulic rescue tool as recited in claim 2 wherein said implement unit is defined as a two-stage mechanical apparatus embodiment which comprises:

a) said yoke configured to form a pusher cam as well as a yoke, with said pusher cam yoke having two mating through-holes for attaching a plurality of linkages, b) said tethered yoke pin having a third LED within a head portion of the pin and a ball lock detent on the opposite end thereof, and c) said vehicle structure separating apparatus consisting of a pair of opposed spreader arms and a bridge for attachment, with each spreader arm having a first end and a second end, with each second end pivotally affixed jointly to each connecting link and said bridge with said removable link pins.

25. The hydraulic rescue tool as recited in claim 24 wherein said yoke further having a triangular shaped body with triangular surfaces contiguously engaging opposed spreader arms first ends and said triangular shape body integrally formed with a cylindrical shank for attachment to said piston rod disposed within said hydraulic cylinder body.

26. The hydraulic rescue tool as recited in claim 24 wherein each spreader arm having roller means configured to interface with the pusher cam yoke defining an initial thrust mode and each spreader arm having a slot therethrough providing an attachment opening for said linkages when axially spreading the arms apart thereby producing a secondary thrust of the tool.

27. The hydraulic rescue tool as recited in claim 24 wherein said linkages are configured as toggle links, each having a rectangular shape with raised bosses on one side at opposed ends for penetrating and sliding within each slot in said spreader arms and to said yoke mating through-holes.

28. The hydraulic rescue tool as recited in claim 2 wherein said implement unit is defined as a pipe and structural head embodiment which comprises:

a) said yoke configured with a hub and an integral blade, said hub attached to said piston rod, b) said tethered yoke pin having a third LED within a head portion of the pin and a adjustable ball lock detent on the opposite end thereof, and c) said vehicle structure separating apparatus consisting of a slotted stop that is aligned with said blade, wherein said blade is urged within the slot of the stop a severing action occurs such as that created by a guillotine.

29. The hydraulic rescue tool as recited in claim 28 wherein said yoke is configured with the hub and an integral blade finther comprises:

a) a unitary steel construction, with said yoke attached to the piston rod with said tethered yoke pin, and b) said blade having a radially offset crescent-shaped point protruding from a straight edge, with both the point and straight edge having a sharp edge.

30. The hydraulic rescue tool as recited in claim 28 wherein said slotted stop further comprises a notched top member, a notched bottom member and two grooved stop extension arms, wherein the extension arms are attached with threaded fasteners on each notch of the top member and each notch of the bottom member, leaving a slot therebetween.

31. The hydraulic rescue tool as recited in claim 28 wherein each extension arm further comprising a bar shape with a first end, a second end and sides, said extension arm further having a longitudinal groove the full length of at least one side, a bolt hole on said first end and said second end configured to fit into said clevis end of said connecting link, with the first end interfacing with notches in the notched top member and the notched bottom member.

32. The hydraulic rescue tool as recited in claim 2 wherein said implement unit is defined as a guillotine head embodiment which comprises:

a) said yoke configured with a hub and an integral blade and said hub attached to said piston rod, b) said tethered yoke pin having a third LED within a head portion of the pin and a ball lock detent on the opposite end thereof, and c) said vehicle structure separating apparatus consisting of a slotted C-shaped jaw configured to receive said blade therein, wherein when said blade is urged within the jaw slot a severing action occurs such as that created by a guillotine.

33. The hydraulic rescue tool as recited in claim 32 wherein said yoke is configured with a hub and an integral blade further comprising:

a) a unitary steel construction, with said yoke attached to the piston rod with said tethered hub pin, and b) said blade having a radially offset crescent-shaped sharp edge on a distal end.

34. The hydraulic rescue tool as recited in claim 32 wherein said slotted C-shaped jaw further comprises:

a) an offset tapered top plate and an offset tapered bottom plate in mirror image, with the top plate and bottom plate contiguously engage together with jaw spacers forming the C-shaped jaw, which is configured to permit the hub and blade to penetrate therethrough, and b) said offset tapered top plate and a bottom plate each having an internal energy absorbing member constructed of flat malleable mild steel, welded in place on an exposed internal surface facing each other.

35. The hydraulic rescue tool as recited in claim 2 wherein said implement unit is defined as a reverse cutting guillotine head embodiment which further comprises:

a) said yoke connected to said piston rod, b) a blade attached to said yoke, and c) a slotted barrier block configured to permit the blade to pass through, when a hook end of said blade surrounds a workpiece and is pulled into the slotted barrier block, a severing action occurs such as that created by a guillotine.

36. The hydraulic rescue tool as recited in claim 35 wherein said yoke further comprises:

a) a unitary steel construction, with said yoke having a flattened hub, with the hub attached to the piston rod, with said tethered yoke pin having a third LED within a head portion of the pin and an adjustable ball lock detent on the opposite end thereof, and b) said yoke configured with an integral channel-shaped blade retainer integrally formed with the hub, said blade retainer having a plurality of through-holes for blade connection.

37. The hydraulic rescue tool as recited in claim 35 wherein said blade further comprises:

a) two discreet flat blade body members juxtapositioned together, with each flat blade member having a plurality of holes through a first end that is configured to mate with said yoke, b) each flat blade body member having a second end configured in a hook shape with a radially offset crescent-shaped sharp edge adjacent to a distal end, c) an internal energy absorbing member disposed in a groove flush with a mating surface on each discreet flat blade body member, with the energy absorbing member constructed of flat malleable mild steel that is welded in place, and d) a plurality of fasteners attaching the blade body to the yoke.

38. The hydraulic rescue tool as recited in claim 35 wherein said blade further comprises:

a) two discreet flat blade body members juxtapositioned together, with each flat blade member having a plurality of holes through a first end configured to mate with said yoke, b) each flat blade body member having a second end configured in a right angular flat hook shape for crimping or crushing, c) an internal energy absorbing member disposed in a groove flush with a mating surface on each discreet flat blade body member, with the energy absorbing member constructed of flat malleable mild steel welded in place, and d) a plurality of fasteners attaching the blade body to the yoke.

39. The hydraulic rescue tool as recited in claim 35 wherein said slotted barrier block further comprises a rectangular body having teeth formed in a front surface and said block having a centrally located slot therethrough that is configured to provide a slide fit for the blade and means to interface with a connecting link on each side.

40. The hydraulic rescue tool as recited in claim 2 wherein said implement unit is defined as a cam cutter embodiment which comprises;

a) said yoke configured as a C-shaped yoke having two in-line through-holes, said yoke allowing attachment of said vehicle structure separating apparatus to said piston rod, and b) said vehicle structure separating apparatus having a U-shaped jaw and a pair of compression arms separated by a cutting blade extending within the U-shaped jaw.

41. The hydraulic rescue tool as recited in claim 40 wherein said C-shaped yoke further comprises:

a) a recessed register adjacent to a first through-hole, b) a shoulder bolt disposed within the in-line through-holes, with said shoulder bolt having a head on a first end and threads on a second end, c) a plurality of flat bearings disposed between the yoke and the compression arms, d) a plurality of flat bearings disposed between the compression arm and the cutting blade, e) a flanged nut attached to the shoulder bolt on the threaded end, with the flange of the nut interfacing with the recessed register permitting a preload, thus allowing the cutting blade to move freely between the compression arms without binding yet sufficiently close to cut cleanly, and f) said tethered yoke pin having a third LED within a head portion of the pin and an adjustable ball lock detent on the opposite end thereof.

42. The hydraulic rescue tool as recited in claim 41 further comprising:

a) said compression arms having a crescent shaped inner edge and a contoured outer edge adjacent to an interface with said U-shaped jaw, and b) said cutting blade having a configuration in mirror image of the compression arms with an edge penetrating the compression arms having a sharp cutting edge permitting the cutting blade to penetrate and sever a workpiece when the arms and blade are pulled together by the hydraulic thrust apparatus.

43. The hydraulic rescue tool as recited in claim 42 wherein said compression arms and cutting blade further comprises:

a) said compression arms having a front end and a rear end with the front end penetrating through the U-shaped jaw and extending therein with the rear end having a yoke hole for connecting to the shoulder bolt disposed within the yoke in-line through-holes, b) a caming projection integrally formed extending outwardly from the yoke hole for caming the arms together when the yoke is extended from the hydraulic thrust apparatus and the caming projections interface with the U-shaped jaw, c) said cutting blade having a front end and a rear end with the front end penetrating through the U-shaped jaw and extending therein with the rear end having a yoke hole for connecting to the shoulder bolt disposed within the yoke in-line through-holes, and d) a caming projection integrally formed extending outwardly from the yoke hole for caming the cutting blade when the yoke is extended from the hydraulic thrust apparatus and the ear projections interface with the U-shaped jaw.

44. The hydraulic rescue tool as recited in claim 40 wherein said U-shaped jaw further comprises: a jaw body incorporating a front end and a rear end facing the hydraulic thrust apparatus, said jaw body having:

a) a connecting link notch on each rear end corner;

b) a front end latch groove through said front end;

c) a plurality of side roller recess openings;

d) an arm and blade slot in said rear end; and e) a caming recess in said rear end interfacing with each caming projection on said compression arms and said cutting blade.

45. The hydraulic rescue tool as recited in claim 44 further comprising a roller pin captivated by a pair of oil impregnated bushings pressed into each side roller recess opening within said U-shaped jaw, and each roller pin having a groove adjacent to each end with a snap ring disposed within each groove for retention of the pin within the U-shaped jaw.

46. The hydraulic rescue tool as recited in claim 44 further comprising a detachable latch disposed within each U-shaped jaw front end latch groove fbr strengthening the jaw's open end, with the latch attached through the jaw with a plurality of tethered quick release pins.

* * * * *